US006473927B1

(12) United States Patent
Sommer

(10) Patent No.: US 6,473,927 B1
(45) Date of Patent: Nov. 5, 2002

(54) SWIMMING BATH CLEANING DEVICE

(75) Inventor: Hans-Rudolf Sommer, Schinznach-Dorf (CH)

(73) Assignee: 3S Systemtechnik AG, Remigen (CH)

( * ) Notice: Subject to any disclaimer, the term of this patent is extended or adjusted under 35 U.S.C. 154(b) by 0 days.

(21) Appl. No.: 09/404,203

(22) Filed: Sep. 23, 1999

(30) Foreign Application Priority Data

Sep. 23, 1998 (CH) ..... 1939/98

(51) Int. Cl.[7] ..... E04H 4/16
(52) U.S. Cl. ..... 15/1.7; 15/347; 210/169
(58) Field of Search ..... 15/117, 347, 350, 15/352, 353; 210/169

(56) References Cited

U.S. PATENT DOCUMENTS

| | | | | | |
|---|---|---|---|---|---|
| 3,310,173 A | * | 3/1967 | Sosower | 15/1.7 |
| 3,886,616 A | * | 6/1975 | Hayes | 15/1.7 |
| 4,168,557 A | | 9/1979 | Rasch et al. | 15/1.7 |
| 4,338,697 A | * | 7/1982 | Broadwater | 15/1.7 |
| 4,962,559 A | * | 10/1990 | Schuman | 15/1.7 |
| 5,269,913 A | * | 12/1993 | Atkins | 210/169 |
| 5,337,434 A | | 8/1994 | Erlich | 15/1.7 |
| 5,569,371 A | * | 10/1996 | Perling | 15/1.7 |

FOREIGN PATENT DOCUMENTS

| | | | | |
|---|---|---|---|---|
| DE | 31 10 203 | | 9/1982 | |
| FR | 2584442 | * | 1/1987 | 15/1.7 |
| FR | 2729995 | | 8/1996 | |
| WO | 87/00883 | | 2/1987 | |
| WO | 90/09498 | | 8/1990 | |

* cited by examiner

*Primary Examiner*—Gary K. Graham
(74) *Attorney, Agent, or Firm*—Venable; Norman N. Kunitz

(57) ABSTRACT

Cleaning device, especially for the cleaning of swimming pools, having a housing (1) and having at least one intake aperture (3) arranged on the base (2) of the housing through which, by means of a pump (4, 4'), a liquid to be cleaned can be conveyed into an inner chamber (5) at least partially enclosed by the housing (1) by a filter (6) which can be arranged in this inner chamber, in order to separate a contamination-exposed part (5') from a clean part (5") of the inner chamber, and through an outlet aperture (7), which is characterized in that the filter (6) lies sealingly on the bottom surface (8) of the inner chamber (5) and an underside (9) of a cover (10) which can be arranged over the inner chamber. Preferred embodiments involve the choice of a lamellar filter, the arrangement of the pump (4, 4') inside or outside the housing (1), at least one motor (14, 14') for driving running wheels (15) for the movement of the cleaning device, and the provision of a sheet metal insert (18) or a bucket insert (19).

18 Claims, 2 Drawing Sheets

SWIMMING BATH CLEANING DEVICE

BACKGROUND OF THE INVENTION

The invention relates, according to the precharacterizing clause of the independent claim 1, to a cleaning device, especially for the cleaning of swimming pools, having a housing and having at least one intake aperture arranged on the base of the housing through which, by means of a pump, a liquid to be cleaned can be conveyed into an inner chamber at least partially enclosed by the housing by a filter which can be arranged in this inner chamber, in order to separate a contamination-exposed part from a clean part of the inner chamber, and through an outlet aperture.

For the cleaning of large liquid containers, especially water-filled swimming pools, it is known to employ cleaning devices with which the cleaning of the pool bottom and, in some cases, the pool walls can be carried out. In such cases, the maintenance of the device, to the extent that the maintenance is necessary at all, is advantageously undertaken from outside the pool of water. Cleaning devices are also known which are designed to be self-propelled and are either controlled by an operative (for example as in EP-A-0 314 259) or moved at random so that essentially the whole bottom of the swimming pool is covered (for example, as in U.S Pat. No. 4,168,557). These cleaning devices, for their movement under water, have wheels which are driven via an electric motor. It is also known to make use of a flow of water caused by an external pump to drive the cleaning device also (for example, as is EP-A-0 468 876). The cleaning device may also be equipped with sensors which, as a result of mechanical contact taking place with a pool wall, effect a change of direction of the cleaning device, so that automatic and complete cleaning of the pool bottom is achieved (for example, as in the same Patent Applicant's EP-A-0 483 470).

In addition to the efficiency of a cleaning device, user-friendly servicing, and in particular, the simple cleaning and replaceability of the filter are of great value. Thus, for example, in the case of the device described in EP-A-0 314 259 and U.S Pat. No. 4,168,557, it is necessary to remove the bottom of the device in order to extract the filter bag. For the removal of the bottom, the cleaning device has to be inclined or tilted to the side, in which case the danger always exists of damage to the control cable or electrical cable leading to the device.

In the case of EP-A-0 468 876, first, no electrical cables exist; the reason for this is the special drive, to which reference has already been made. Secondly, the lateral pulling-out is described of a part of the housing to which the filter is connected. For cleaning, this part of the housing is designed to be open on two sides; this means, however, that, in contrast to the two cleaning devices described above (EP-A-0 314 259 and U.S Pat. No. 4,168,557), a part of the device has inner surfaces which are exposed to contamination and also have to be cleaned. Again, however, an inclination of the device to the side is necessary for the cleaning and, especially, visual inspection of these inner surfaces.

The eddy wheel serving as a pump in EP-A-0 483 470 is—in contrast to all other cited devices—exposed to contamination and has to be cleaned from time to time, which may also be regarded as a disadvantage.

BRIEF SUMMARY OF THE INVENTION

The object of the present invention is to provide a cleaning device, especially for the cleaning of swimming pools, in which the filter can be exchanged and/or all contamination-exposed parts of the cleaning unit can be cleaned without its being necessary to raise or tilt the device, and in which no parts of the pump come into contact with contaminated liquid.

This object is achieved by the provision of a cleaning device, especially for the cleaning of swimming pools, in accordance with the features of the independent claim 1. This cleaning device comprises a housing and at least one intake aperture arranged on the base of the housing through which, by means of a pump, a liquid to be cleaned can be conveyed into an inner chamber at least partially enclosed by the housing by a filter which can be arranged in this inner chamber, in order to separate a contamination-exposed part from a clean part of the inner chamber, and through an outlet aperture, and which is characterized in that the filter lies sealingly on the bottom surface of the inner chamber and an underside of a cover which can be arranged over the inner chamber. Preferred developments of the cleaning device according to the invention are apparent from the dependent claims.

BRIEF DESCRIPTION OF THE DRAWINGS

The invention, as characterized in the claims, is described below with reference to diagrammatic drawings. The figures are to be understood merely as an illustration of the invention and are not intended to restrict the scope of protection in any way. In the drawings:

FIG. 4B showing, in vertical section, a combination of insert bucket with membrane insert.

DETAILED DESCRIPTION OF THE INVENTION

Figure 1:
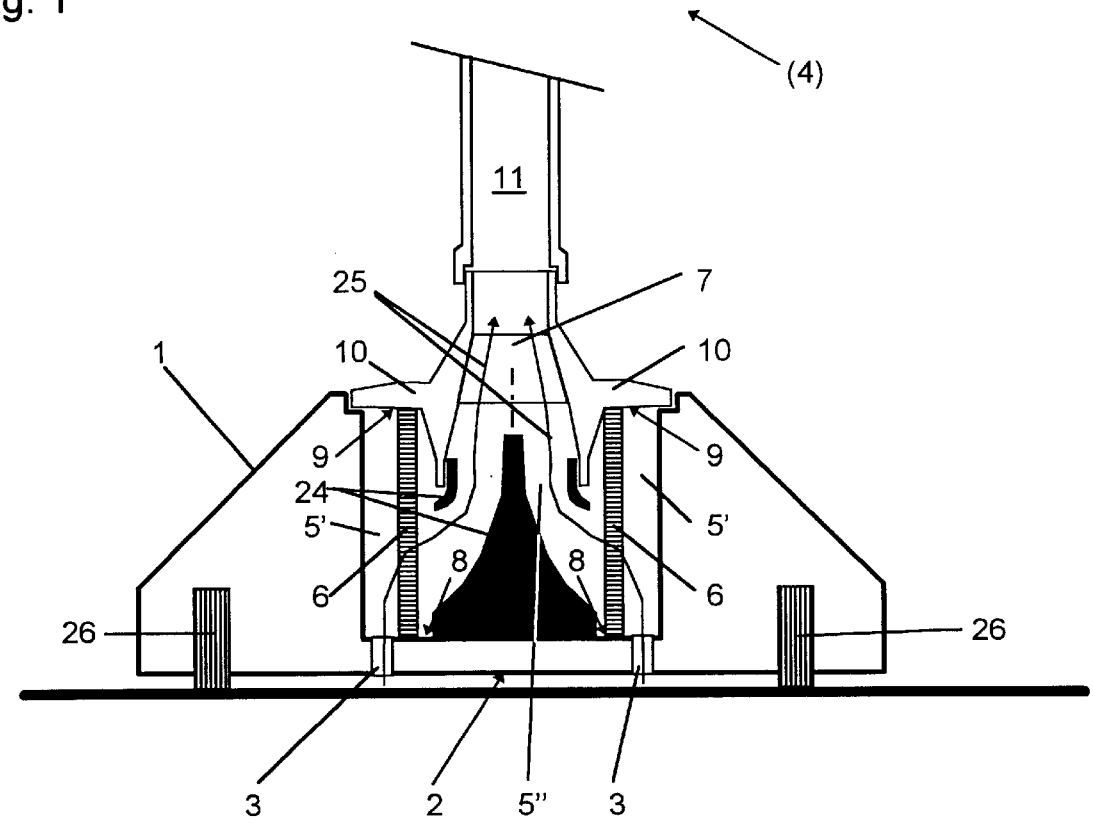
FIG. 1 shows a vertical section through a cleaning device according to the invention, in accordance with a first embodiment.

FIG. 1 shows a vertical section through a cleaning device according to the invention, in accordance with a first embodiment. The cleaning device possesses a housing 1 with a base 2 on which at least one intake aperture 3 is arranged. The liquid to be conveyed is aspirated by a pump 4, which is arranged outside the housing 1 in the swimming pool or alternatively outside the latter. This liquid, which is described hereinafter for the sake of simplicity as water, contains, depending on the degree of contamination of the swimming pool, inorganic materials such as dust, sand, stones and the like and, often, additionally biological material such as plant or animal remains and algae or other small organisms. The water passes through the intake aperture or apertures 3 into an inner chamber 5 which is at least partially surrounded by the housing 1 and is sucked through a filter 6 arranged in this inner chamber. Before the water passes through the filter 6 it is described as contaminated water and thereafter as filtered water. The filtered water passes through at least one outlet aperture 7, which is preferably arranged within a cover 10 and essentially centrally above the inner chamber, out of the inner chamber of the housing 1. This cover 10 thus closes off at least part of the inner chamber 5. The filter 6 is preferably designed as a lamellar filter of cylindrical shape and is in contact with the bottom surface 8 of the inner chamber on one side and the underside 9 of the cover 10 of the inner chamber on the other side. This contact is such that virtually no water can pass from the contamination-exposed part 5' of the inner chamber 5 into the clean part 5" thereof. In order to improve this contact, and hence the seal, a sealing member, for example in the form of sealing lips, can in each case be provided at the contact surfaces of the filter 6 with the corresponding surfaces 8, 9 or on the regions of the surfaces 8, 9 contacted by the filter. If the device is connected to the pump 4 via a suction line 11, which can be fixed to the cover 10 or connected thereto, the device placed in a swimming bath at least partially filled with water and the pump 4 set to operate, a vacuum forms in the clean part 5" of the inner chamber 5. This vacuum causes a flow within the inner chamber of the device which is shown diagrammatically by the two arrows 25. Within the clean part 5" of the inner chamber 5 limited by the filter 6, flow guides 24 may additionally be arranged to reinforce or accelerate the water flow or to divert it. This first embodiment has no drive mechanisms for the movement of the cleaning device and is consequently moved by hand or with an additional movement device during the cleaning of a swimming pool, so that essentially the entire swimming pool—preferably bottom and walls—can be cleaned.

Figure 2:
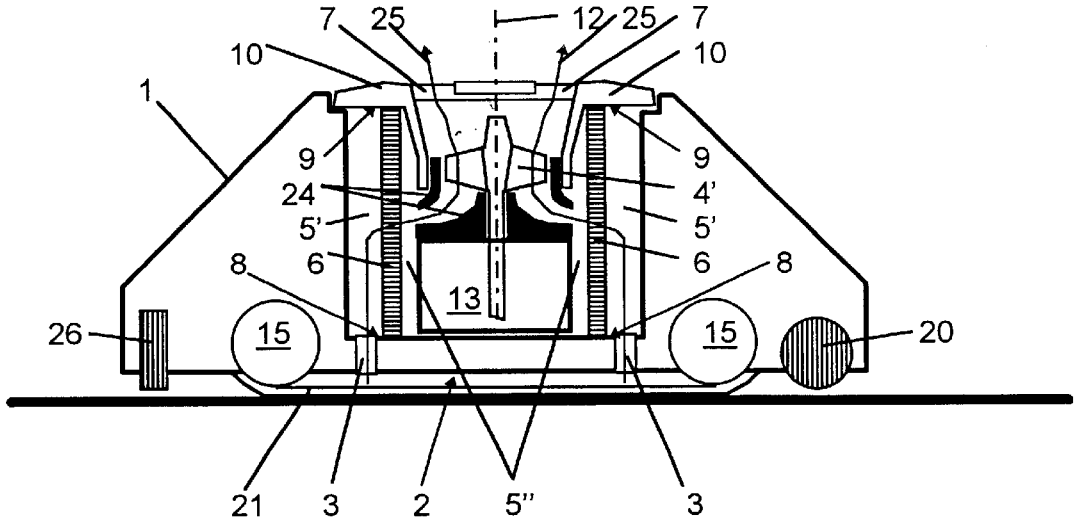
FIG. 2 shows a vertical section through a cleaning device according to the invention, in accordance with a second embodiment.

FIG. 2 shows a vertical section through a cleaning device according to the invention, in accordance with a second embodiment. All parts of the cleaning device common to the first and second embodiments are provided with the same reference numbers and are not listed again here. By contrast with the first embodiment, however, the pump 4' is in this case arranged within the housing 1, and specifically in the clean part 5" of the inner chamber 5. The pump 4' is actively connected via a shaft 12 to an electric motor 13 which is arranged close to the bottom surface 8 of the inner chamber 5 and is arranged together therewith vertically in the inner chamber 5. The electric motor 13 and the pump 4' are arranged coaxially to and within the filter 6, which is of cylindrical shape. The outlet apertures 7 are arranged in the essentially vertical direction above the pump 4'. If the device is placed in a swimming bath at least partially filled with water and the pump 4' is set to operate, a vacuum is formed in the clean part 5" of the inner chamber 5. This vacuum causes a flow within the inner chamber of the device which is shown diagrammatically by the two arrows 25. Within the clean part 5" of the inner chamber 5 limited by the filter 6, flow guides 24 may additionally be arranged to reinforce or accelerate the water flow or to divert it.

Figure 3:
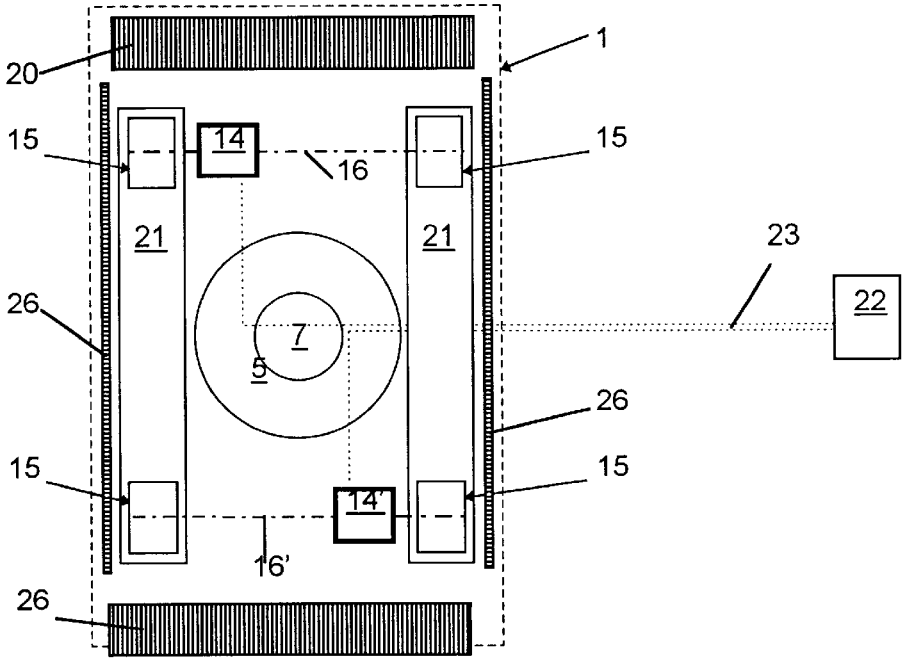
FIG. 3 shows a ground plan corresponding to FIG. 2.

The contaminated water passes through the intake aperture or apertures 3 into the contamination-exposed part 5' of the inner chamber 5 which is at least partially surrounded by the housing 1 and is sucked through a filter 6 arranged in this inner chamber. The filtered water moves past the flow conductors 24, is conveyed onwards by the pump 4' or its propeller passes through at least one outlet aperture 7, which is preferably arranged within a cover 10 and essentially centrally above the inner chamber, out of the inner chamber 5 of the housing 1. This cover 10 thus closes off at least part of the inner chamber 5. The filter 6 is preferably designed and arranged as a lamellar filter in accordance with the first embodiment. In contrast to the first embodiment, one or more motors (cf. FIG. 3) are provided in this second embodiment and serve to drive the running wheels 15 or their axles 16, 16'. Preferably, at least one motor 14, 14' is provided to drive the running wheels 15 for the movement of the cleaning device, each pair of running wheels 15 being arranged on an axle 16, 16' and an independent motor 2, 2' being assigned to each axle 15, 15'. A control system 22 is preferably arranged outside the cleaning device and connected to the cleaning device via a control line 23, so that, for example, an operative outside the swimming pool or an automatic system, which may be connected to a computer or itself have built-in artificial intelligence, can control the cleaning device. In the case of built-in artificial intelligence, however, provision may also be made for the control system to be located within the housing and for the local conditions there to be stored in an electronic storage medium, such as, for example, a so-called "smart card", and this storage medium may be part of the control system or capable of being inserted into it; in this case, the arrangement of energy storage media, such as batteries and the like, within the housing is advantageous. In this manner, the cleaning device is completely self-contained and can be used for independent cleaning of a liquid container, especially of a swimming pool.

By way of divergence from the two embodiments shown in FIGS. 1 and 2, in accordance with a third embodiment (not shown), a pump may be arranged directly on or in the immediate vicinity of the cover 10, outside the inner chamber 5. A motor drive may be provided.

Further embodiments, which for example encompass an external pump 4 (cf. FIG. 1) and a motor drive with rollers 15 (cf. FIG. 2) or an internal pump 4' (cf. FIG. 2) and no motor drive with rollers 15 (cf. FIG. 1) also form part of the present invention, as does any desired combination of pump arrangement, method of movement and method of control.

For the intensive cleaning of the underlying surface, which may encompass both the bottom and the walls of the swimming pool, brushes 26 and/or brush rollers 20, known per se, are used optionally in all three embodiments described. These brushes or brush rollers may be arranged both lengthwise and crosswise in the region of the base 2 of the housing or in the region of the edge of the housing inside or alternatively—by way of divergence from the illustration in FIG. 2—outside the housing.

Figure 4A:
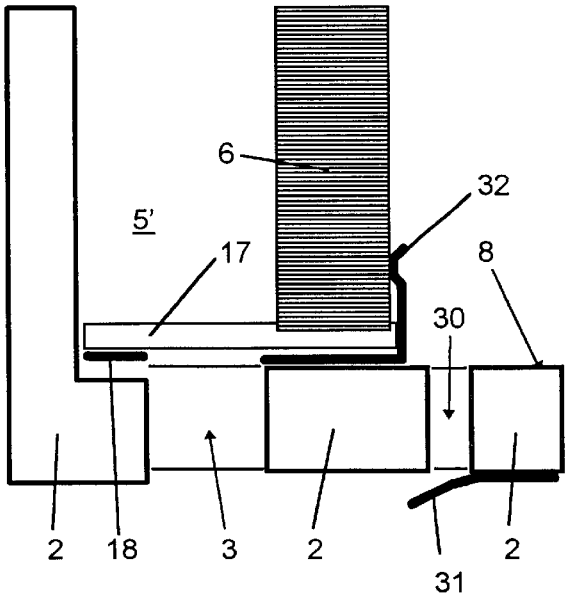
FIGS. 4A, 4B show an enlarged vertical section through an intake aperture, FIG. 4A showing, in vertical section, a combination of sheet metal insert with membrane insert.

FIG.4A shows an enlarged vertical section through an intake aperture, a combination of sheet metal insert 18 and membrane insert 17 being shown. The sheet metal insert lies directly on the bottom surface 8 of the inner chamber 5, or the contamination-exposed part 5' thereof, and essentially covers that part of the bottom surface 8 of the inner chamber. Optionally provided sealing members (not shown) between bottom surface 8 and sheet metal insert 18 may additionally prevent contaminated water from penetrating directly from the intake apertures 3 into the clean part 5" of the inner chamber. On the sheet metal insert 18 lies a membrane insert 17, which covers the intake holes 3. When a vacuum is formed in the inner chamber 5 as a result of the operation of a pump 4, 4', the elastically deformable membrane, which is produced, for example, from rubber, is bent upwards in the region of the intake apertures 3. The intake apertures are thus open. As soon as the vacuum is removed, for example because the pump 4, 4' has been shut down, the membrane insert 17 immediately rests again over the intake apertures 3 and closes the latter; the membrane insert thus acts like a one-way valve or non-return valve which, although it allows contaminated water to flow into the inner chamber, nevertheless prevents the outflow thereof. The effect of this is that a substantial quantity of contamination, for example when the pump is shut down, leaves the cleaning device in an uncontrolled manner and thus contaminates the swimming bath or its surroundings. However, in order for the water which is located in the cleaning device after the pump 4, 4' is shut down to be removed in a controlled manner, one or more drainage apertures 30 are provided in the region of the clean part 5" of the inner chamber. In the opposite manner to what occurs with the intake apertures 3, a membrane piece acting as a valve 31 is provided at the drainage aperture or apertures 30 and is arranged on the outside of the base 2 of the housing. During pump operation, this membrane piece 31 is aspirated, so that all drainage apertures are closed. As soon as the vacuum in the inner chamber 5 declines, all membrane valves 31 are depressed by the weight of the water present in the inner chamber, whereupon the water drains away. As a result of the fact that the drainage apertures 30 are provided in the bottom region of the clean part 5" of the inner chamber, only water which has passed through the filter and is thus cleaned leaves the inner chamber; the contamination is thus effectively retained in the contamination-exposed part 5' of the inner chamber.

Figure 4B:
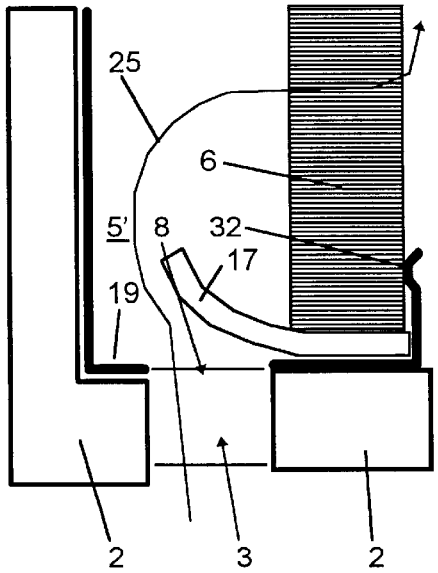

FIG. 4B shows an enlarged vertical section through an intake aperture, a combination of sheet metal insert 18 with bucket insert 19 being shown. Like the sheet metal insert 18 in FIG. 4A, the bucket insert 19 in this case lies directly on the bottom surface 8 of the inner chamber 5 or its contamination-exposed part 5' and essentially fills the contamination-exposed part of the inner chamber. Optionally provided sealing members (not shown) between bottom surface 8 and bucket insert 19 may additionally prevent contaminated water from penetrating directly from the intake apertures 3 into the clean part 5" of the inner chamber. On the bucket insert 19 lies a membrane insert 17 which covers the intake holes 3 and, in a manner corresponding to that described in FIG. 4A, acts as a one-way valve. corresponding drainage apertures 30 with membrane valves 31 may also be provided.

For reciprocal stabilization and in order to simplify the cleaning of the device (see below), the sheet metal insert 18 or the bucket insert 19 preferably has clips 32 which connect the inserted lamellar filter 6 to the sheet metal insert or the bucket insert, as the case may be, and grip or clamp the membrane insert 17 between the lamellar filter and the sheet metal insert or bucket insert.

The use of a lamellar filter has the advantage that, if the slats are oriented essentially horizontally, small particles which, according to experience, constitute the great majority of the contamination to be retained by the filter come to rest on or between the slats, as on shelves, and—when the device is later cleaned—can be lifted from the inner chamber together with the filter. A lamellar filter having essentially vertically arranged slats, however, has the advantage that it can be introduced simply into a cylindrical shape, because the slats extend virtually parallel to the axis of the cylinder and, by bending at the cylinder surface, the intervening spaces between the slats—depending on the number of slats—can simply be upended or stretched slightly. It has been found that in the case of essentially vertically extending slats also, the great majority of the contamination to be retained by the filter deposits in the intervening spaces between the slats and can likewise be removed from the cleaning device when the filter is lifted out.

The cleaning of the device takes place as follows:

By shutting down the pump 4, 4', the device is disconnected and, for example, withdrawn from the swimming pool by means of a lifting rope. When this occurs, the filter chamber or the inner chamber 5 is drained through the drainage apertures 30, described previously, arranged on the base of the housing 2 in the clean part 5" of the inner chamber.

The inner chamber 5 or the filter chamber is made accessible by removing the cover 10.

The lamellar filter 6 is withdrawn essentially vertically upwards from the filter chamber. If a sheet metal insert 18 or a bucket insert 19 is used, these inserts can simply be lifted out together with the lamellar filter.

If no such inserts 18, 19 are provided, a more frequent visual control is advisable to determine whether the contamination-exposed part 5' of the inner chamber 5 is already so heavily contaminated that the lamellar filter 6 cannot accept much, or any, additional load contamination. A cover 10 which comprises transparent material, such as transparent plastic and the like, or is made therefrom, considerably facilitates this optical inspection.

In general, a transparent cover has the advantage that the degree of contamination of the filter 6 can be ascertained in a simple manner and even during the operation of the cleaning device.

The inserts, which are held together, for example, via clips 32 and comprise, for example, the filter 6, the sheet metal insert 18 or bucket insert 19 latched thereto and the membrane inserts 17, slide together out of the filter chamber, coarse contamination being prevented from falling back into the chamber. The use of a bucket insert 19 additionally prevents contaminated water coming into direct contact with the inside wall of the inner chamber 5. As a result of the fact that (apart from the cover 10) no internal parts of the housing 1 come into contact with contaminated water, the cleaning of the cleaning device is additionally simplified.

Any fine contaminants can be washed out from above with cleaning water from the inner chamber 5, in other words from the filter chamber and pump chamber, through the intake apertures 3 and drainage apertures 30, especially if merely a membrane insert 17 and a filter 6 are used (in other words, no sheet metal insert 18 or bucket insert 19).

As a result of the use of a membrane insert 17, and also if appropriate of a sheet metal insert 18 or bucket insert 19, and a clean or cleaned filter 6, the cleaning device is immediately ready for its next use without its having had to be tilted laterally every time, and certainly not turned over.

Preferably, an independent motor 2, 2' is assigned to each axle 15, 15' in a cleaning device. However, a joint motor for both axles may also be provided. The design of the housing 1 of the cleaning device as a self-supporting plastic frame has proved its value. It is particularly preferred, however, for the plastic frame to be of integral design, as this simplifies production and, especially, assembly substantially.

What is claimed is:

1. A cleaning device, comprising:

a housing with a base arranged adjacent to a surface of a liquid container containing a liquid to be cleaned, the housing defining at least one intake aperture arranged on the base of the housing and at least one outlet aperture, the housing having an inner chamber with a contamination-exposed part and a clean part, the inner chamber being at least partially enclosed by the housing and having a bottom surface;

a removable cover with an underside arranged over the inner chamber;

a filter arranged in the inner chamber for separating the contamination-exposed part and the clean part of the inner housing, the filter extending between and forming a seal with the bottom surface of the inner chamber and the underside of the cover; and a pump, an electric motor, and a shaft arranged in the inner chamber, the shaft actively connecting the pump to the electric motor, and the pump pumping the liquid to be cleaned into the contamination-exposed part of the inner chamber, through the filter, through the clean part of the inner chamber and through the at least one outlet aperture.

2. The cleaning device according to claim 1, wherein the filter is a lamellar filter.

3. The cleaning device according to claim 1, wherein the electric motor is arranged approximately adjacent to the bottom surface of the inner chamber.

4. The cleaning device according to claim 1, wherein the filter has a cylindrical shape, the electric motor and the pump being arranged coaxially to and within the filter.

5. The cleaning device according to claim 1, wherein the at least one outlet aperture is arranged above the pump.

6. The cleaning device according to claim 1, wherein the at least one outlet aperture is arranged in the removable cover.

7. The cleaning-device according to claim 1, further comprising running wheels for moving the device and at least one additional motor for driving the running wheels.

8. The cleaning device of claim 7, further comprising an axle for mounting the running wheels.

9. The cleaning device of claim 7, further comprising at least one axle for mounting the running wheels, the at least one additional motor including an independent motor for each axle.

10. The cleaning device of claim 1, wherein the housing is designed as a self-supporting plastic frame.

11. The cleaning device of claim 10, wherein the plastic frame is of an integral design.

12. The cleaning device of claim 1, further comprising a membrane insert which serves as a non-return valve for the at least one intake aperture.

13. A cleaning device of claim 1, further comprising a sheet metal insert essentially covering the contamination-exposed part on the bottom surface of the inner chamber.

14. The cleaning device of claim 1, further comprising an insert bucket essentially filling the contamination-exposed part of the inner chamber.

15. The cleaning device of claim 1, wherein the cover comprises transparent material.

16. The cleaning device of claim 1, wherein the housing further defines at least one drainage aperture arranged in the clean part of the inner chamber, the device further comprising at least one membrane valve arranged on the at least one drainage aperture.

17. The cleaning device of claim 1, wherein the pump is arranged in the clean part of the inner chamber.

18. The cleaning device of claim 1, further comprising running wheels and at least one brush arranged on the housing, the running wheels and the at least one brush being operated independently from one another.

* * * * *